US009631267B2

(12) United States Patent
Chen

(10) Patent No.: US 9,631,267 B2
(45) Date of Patent: Apr. 25, 2017

(54) METHOD FOR MAKING METALLIC GLASS AND DEVICE FOR MAKING THE SAME

(71) Applicant: Kuan Wei Chen, Taitung (TW)

(72) Inventor: Kuan Wei Chen, Taitung (TW)

( * ) Notice: Subject to any disclaimer, the term of this patent is extended or adjusted under 35 U.S.C. 154(b) by 289 days.

(21) Appl. No.: 14/166,838

(22) Filed: Jan. 28, 2014

(65) Prior Publication Data

US 2014/0326366 A1 Nov. 6, 2014

(30) Foreign Application Priority Data

May 3, 2013 (TW) ..... 102115992 A

(51) Int. Cl.
*C22C 45/00* (2006.01)
*C22F 1/00* (2006.01)

(52) U.S. Cl.
CPC ..... *C22C 45/00* (2013.01); *C22F 1/002* (2013.01)

(58) Field of Classification Search
None
See application file for complete search history.

(56) References Cited

U.S. PATENT DOCUMENTS 4,495,691 A * 1/1985 Masumoto ..... B21C 37/047 148/403
4,607,683 A * 8/1986 Hamashima ..... B22D 11/005 164/423
4,614,221 A * 9/1986 Masumoto ..... B22D 11/005 164/423
4,806,179 A * 2/1989 Hagiwara ..... C22C 45/008 148/403
6,044,893 A * 4/2000 Taniguchi ..... B22D 17/12 164/113
2008/0103594 A1* 5/2008 Loffler ..... A61L 27/427 623/11.11

* cited by examiner

*Primary Examiner* — George Wyszomierski

(57) ABSTRACT

A method and device for making metallic glass includes a first step of preparing metal or alloy; a second step of melting metal or alloy into liquid metal; a third step of putting the liquid metal into a boiler and applying pressure into the boiler and the liquid metal being ejected into lines from an outlet located a the lower portion of the boiler; a fourth step of cooling the lines as ejected from the outlet of the boiler in a cooling tank by a quick-flowing coolant; a fifth step of forming straight metallic glass fibers and allowing the metallic glass fibers to be settled to the bottom of the cooling tank; a sixth step of weaving the metallic glass fibers into pieces, and a seventh step of overlapping the pieces into a metallic glass. The lower portion of the boiler is located at a lower level than a surface of the coolant as quickly flowing in the cooling tank.

2 Claims, 2 Drawing Sheets

METHOD FOR MAKING METALLIC GLASS AND DEVICE FOR MAKING THE SAME

BACKGROUND OF THE INVENTION

1. Fields of the Invention

The present invention relates to a method for making metallic glass and a device for making the same, and more particularly, to a method making the melted metal into lines by way of injection molding, and the lines are woven to be pieces which are overlapped to form the metallic glass.

2. Descriptions of Related Art

In general, metal is formed by a combination of crystals, and the crystal structure provides metal ductility that is uneasy to break. Amorphous alloy structure is irregular and has no crystallization, or the amorphous alloy structure, just like plastic and glass, is disordered on the atomic scale. Glass is formed when any substance is cooled from liquid to solid without crystallization, and most metals will crystallize when cooled. If no crystallization occurs, atoms will be arranged randomly to form metallic glass, so that amorphous alloy (which is also known as metallic glass) is usually as fragile as glass.

At present, thinner and finer metal glass is produced, since when metal is cooled, crystallization occurs quickly, so that it is necessary to cool liquid to solid before crystallization occurs and maintains metal glass at a solid state without crystallization at high temperature. Therefore, the conventional manufacturing technology cannot produce metal glass with a large area and a large diameter or provide large-size metallic glass (amorphous alloy) for industrial use. Obviously, it is one of the urgent and important issues to produce large-size metallic glass with high hardness, strength, tenacity and ductility.

The present invention intends to provide a method and device for making metallic glass, and the shortcomings mentioned above are improved.

SUMMARY OF THE INVENTION

The present invention relates to a method and device for making metallic glass and the method comprises a step of preparing metal or alloy; a step of melting metal or alloy into liquid metal; a step of putting the liquid metal into a boiler and applying pressure into the boiler and the liquid metal being ejected into lines from an outlet located at the lower portion of the boiler; a step of cooling the ejected lines from the outlet of the boiler in a cooling tank by quick-flowing coolant; a step of forming straight metallic glass fibers and allowing the metallic glass fibers to be settled to the bottom of the cooling tank; a step of weaving the metallic glass fibers into pieces, and a step of overlapping the pieces into a metallic glass.

Preferably, the speed that the coolant flows is faster than the ejecting speed of the liquid metal.

The device for making metallic glass comprises a boiler and a cooling tank. The boiler has an outlet located at the lower portion thereof. The lower portion of the boiler is located at a lower level than a surface of a quick-flowing coolant as filled and flowing in the cooling tank.

The primary object of the present invention is to provide a method for making a metallic glass of different sizes, especially for making the metallic glasses with larger sizes.

The present invention has the following advantages:

1. The method and device of the present invention can manufacture the metallic glasses in different sizes, especially for larger sizes of metallic glasses.

2. The method of the present invention has simple manufacturing steps and can manufacture the metallic glasses at lower cost.
3. The method and device of the present invention can manufacture the metallic glasses in different sizes, with high stiffness, high strength, flexibility, extensibility, magnetic features, durability to wear and corrosion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
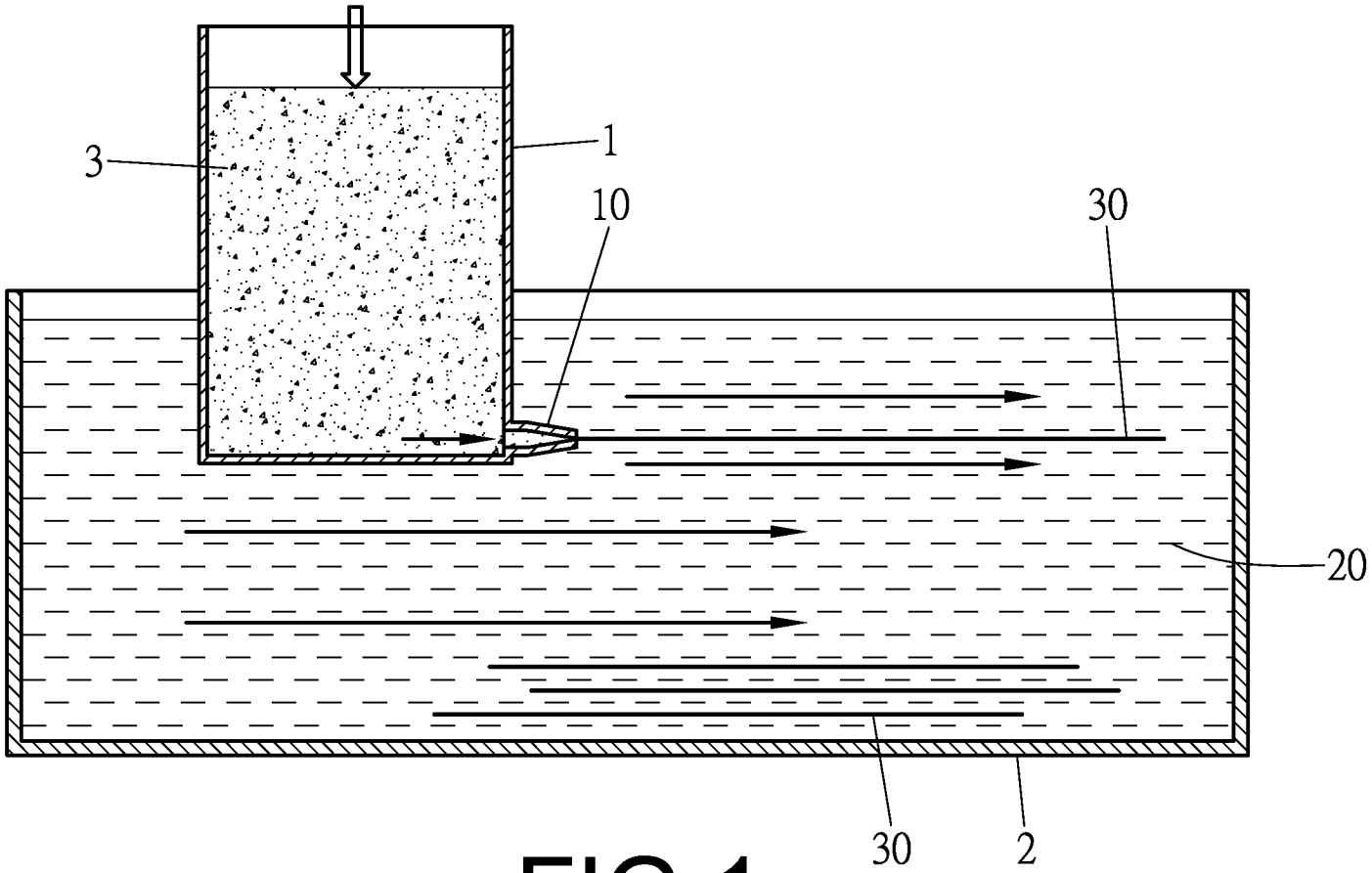
FIG. 1 shows the device of the of the present invention when manufacturing the metallic glass fibers.

Referring to FIG. 1, the device of the present invention comprises a boiler 1 and a cooling tank 2. The boiler 1 has an outlet 10 located at the lower portion thereof. The cooling tank 2 is filled with coolant 20 which flows at fast speed. The lower portion of the boiler 1 is located at a lower level than a surface of the coolant 20 as quickly flowing in the cooling tank 2.

Figure 2:
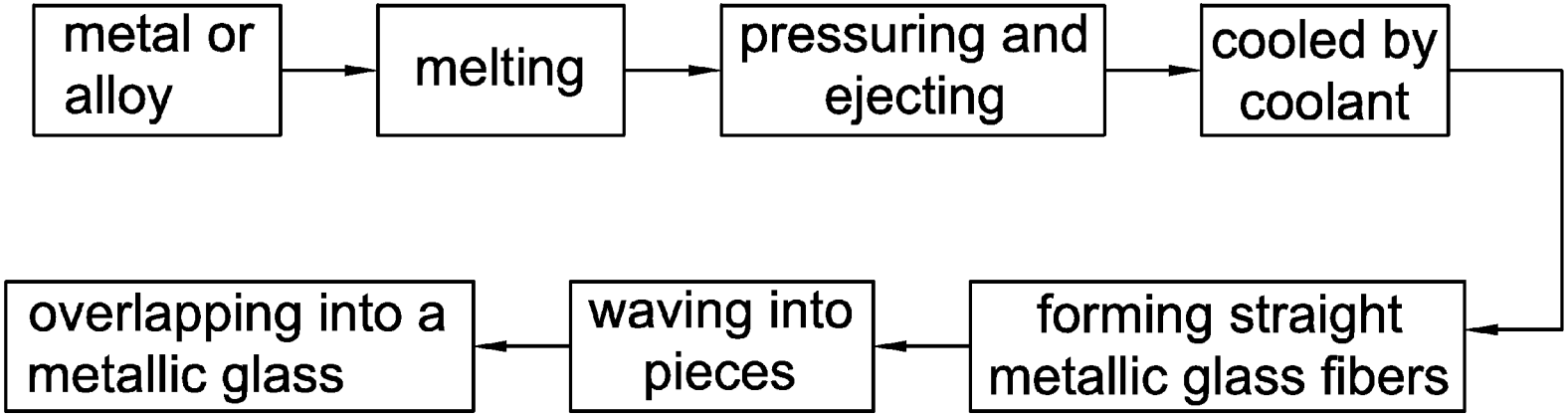
FIG. 2 shows the steps of the method of the present invention.

As shown in FIG. 2, the method for making metallic glass of the present invention comprises the following steps:

A. preparing melting metal of alloy, such as Titanium based, Magnesium based, copper based and Iron based metal or alloy;

B. melting metal or alloy into liquid metal 3;

C. putting the liquid metal 3 into a boiler 1, applying pressure into the boiler 1 and ejecting the liquid metal 3 into the lines through an outlet 10 located at a lower portion of the boiler 1;

D. cooling the lines as ejected from the outlet 10 of the boiler 1 in a cooling tank 2 by a quick-flowing coolant 20, wherein a speed that the coolant 20 flows is larger than an ejecting speed of the liquid metal 3 to prevent the line of the liquid metal 3 form being curved;

E. forming straight metallic glass fibers 30, allowing the metallic glass fibers 30 to be settled to the bottom of the cooling tank 2;

F. weaving the metallic glass fibers 30 into pieces, and

G. overlapping the pieces into a metallic glass.

The method of the present invention is able to make the metallic glass of different sizes, especially for making the larger size of the metallic glasses.

The liquid metal 3 is cooled before being crystallized so as to form the metallic glass fibers 30 which are flexible and durable. The metallic glass fibers 30 are woven into pieces and the pieces are then overlapped to form a metallic glass. The metallic glass can be made into different sizes as needed. These metallic glasses have high stiffness, high strength, flexibility, extensibility, magnetic features, and are durable to wear and corrosion. The metallic glasses can be used to make portable electronic devices, space products, medical products and exercise products.

While we have shown and described the embodiment in accordance with the present invention, it should be clear to those skilled in the art that further embodiments may be made without departing from the scope of the present invention.

What is claimed is:

1. In a method for making metallic glass, comprising the following steps:

A. preparing a metal or alloy to be melted;

B. melting said metal or alloy into a liquid metal;

C. putting the liquid metal into a boiler, applying pressure into the boiler and ejecting the liquid metal into lines through an outlet located at a lower portion of the boiler;

D. cooling the lines as ejected from the outlet of the boiler in a cooling tank by a quick-flowing coolant;

E. forming straight metallic glass fibers, allowing the metallic glass fibers to be settled to the bottom of the cooling tank;

F. weaving the metallic glass fibers into pieces, and

G. overlapping the pieces into a metallic glass;

the improvement which comprises that:

the lower portion of the boiler is located at a lower level than a surface of the quick-flowing coolant in the cooling tank.

2. The method as claimed in claim 1, wherein a speed that the coolant flows is faster than an ejecting speed of the liquid metal.

* * * * *